US006439312B1

(12) United States Patent
Hess et al.

(10) Patent No.: US 6,439,312 B1
(45) Date of Patent: Aug. 27, 2002

(54) APPARATUS AND METHODS FOR ISOLATING A WELLBORE JUNCTION

(75) Inventors: Joseph E. Hess; Benji Smith, both of Spring, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/637,494

(22) Filed: Aug. 11, 2000

(51) Int. Cl.[7] ..... E21B 43/12

(52) U.S. Cl. ..... 166/313; 166/50; 166/116; 166/387

(58) Field of Search ..... 166/50, 115, 116, 166/244.1, 313, 378, 380, 387

(56) References Cited

U.S. PATENT DOCUMENTS

| | | | | |
|---|---|---|---|---|
| 2,728,395 | A | | 12/1955 | Howard |
| 2,894,588 | A | | 7/1959 | Tausch et al. |
| 3,361,204 | A | | 1/1968 | Howard et al. |
| 5,337,808 | A | * | 8/1994 | Graham |
| 5,941,307 | A | * | 8/1999 | Tubel |
| 6,062,306 | A | * | 5/2000 | Gano et al. |
| 6,065,543 | A | | 5/2000 | Gano et al. |
| 6,092,602 | A | * | 7/2000 | Gano |

FOREIGN PATENT DOCUMENTS

| | | |
|---|---|---|
| EP | 0 701 045 A2 | 3/1996 |
| GB | 2332919 A | 7/1999 |
| GB | 2333545 A | 7/1999 |

OTHER PUBLICATIONS

European Search Report for Application No.: GB 0119587.4.

* cited by examiner

*Primary Examiner*—Roger Schoeppel
(74) *Attorney, Agent, or Firm*—William M. Imwalle; Marlin R. Smith

(57) ABSTRACT

A wellbore junction isolation method and associated apparatus provide convenient isolation of a wellbore junction while permitting certain operations to be performed in a wellbore below the junction. In a described embodiment, a formation intersected by a main wellbore below a wellbore junction is stimulated by fracturing after installing an assembly at the wellbore junction to isolate it from pressures applied during the fracturing operation. In this embodiment, the assembly is installed in a single trip into the main wellbore.

16 Claims, 2 Drawing Sheets

APPARATUS AND METHODS FOR ISOLATING A WELLBORE JUNCTION

BACKGROUND

The present invention relates generally to operations performed in conjunction with a subterranean well and, in an embodiment described herein, more particularly provides a wellbore junction isolation method and associated apparatus.

Wellbore junctions are formed at intersections of wellbores in a well. For example, a main or parent wellbore may have a branch or lateral wellbore drilled extending outwardly from an intersection between the main and branch wellbores. Of course, the main wellbore may extend below the intersection with the branch wellbore, for example, to intersect a formation from which it is desired to produce hydrocarbons into the main wellbore.

Unfortunately, however, some wellbore junctions are not able to withstand substantial internal pressure applied thereto. For this reason, pressure within these wellbore junctions is limited to the fracture gradients of the respective formations in which the wellbore junctions are positioned. Thus, if stimulation operations, such as fracturing, must be performed for any formations below the wellbore junctions, expensive, time-consuming and/or complicated procedures must be used to prevent exceeding the fracture gradients of the formations at the wellbore junctions.

Therefore it would be quite desirable to provide a method of isolating a wellbore junction which is convenient and easily performed, and which isolates the wellbore junction from pressures applied through the junction.

SUMMARY

In carrying out the principles of the present invention, in accordance with an embodiment thereof, a method of isolating a wellbore junction is provided in which an isolating assembly is positioned at the wellbore junction and sealingly engaged in a wellbore. The assembly isolates at least one flow passage extending therethrough from the wellbore junction. Pressure may then be applied to the flow passage without that pressure being communicated to the wellbore junction.

In one aspect of the invention, the assembly includes two sealing devices which are sealingly engaged between the assembly and one of the wellbores intersecting at the wellbore junction. The sealing devices are sealingly engaged straddling the wellbore junction. In this manner, an annulus formed between the assembly and the wellbore in which the sealing devices are sealingly engaged is divided into three portions, a middle one of which is in fluid communication with the wellbore junction.

In another aspect of the invention, the other two annulus portions are in fluid communication with each other via another flow passage formed through the assembly. Thus, a circulation flowpath is formed between the annulus portions above and below the wellbore junction extending through the assembly.

In yet another aspect of the invention, the assembly is conveniently installed in a single trip into the well. A particular embodiment described herein includes inner and outer tubular structures, with the sealing devices on the outer structure, and the inner structure sealed to the outer structure above and below the sealing devices.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
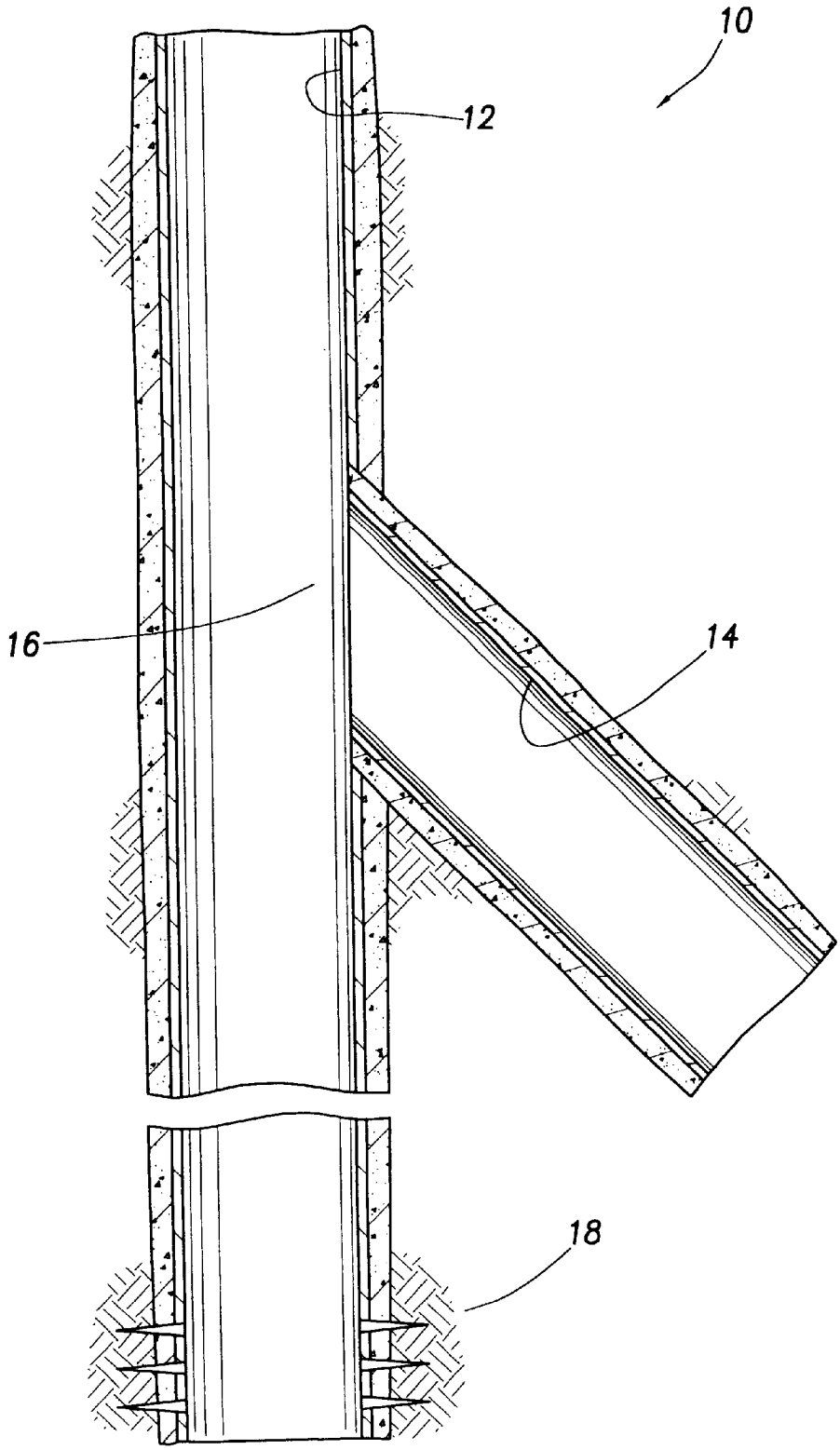
FIG. 1 is a schematic view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Specifically, the term "above" is used herein to designate a direction toward the earth's surface along a wellbore, and the term "below" is used herein to designate a direction away from the earth's surface along a wellbore, even though the wellbore may not be substantially vertical. Additionally, it is to be understood that the various embodiments of the present invention described herein may be utilized in various orientations, such as inclined, inverted, horizontal, vertical, etc., and in various configurations, without departing from the principles of the present invention.

Referring now to FIG. 1, the method 10 is described herein as being performed at a wellbore junction 16 formed by an intersection between a main wellbore 12 and a branch wellbore 14. The wellbores 12, 14 are depicted in FIG. 1 as being cased or lined, but it is to be clearly understood that the principles of the invention may be incorporated into other methods performed in uncased or unlined wellbores. Furthermore, the principles of the invention are not limited to wellbore junctions formed between main and branch wellbores.

As illustrated in FIG. 1, the main wellbore 12 extends below the wellbore junction 16 to intersect a formation or zone 18. It is desired to perform a stimulation operation, such as fracturing, on the formation 18 to thereby increase production of hydrocarbons therefrom. However, it is also desired not to apply excessive internal pressure to the wellbore junction 16. Of course, the principles of the invention may be incorporated into other methods in which it is not desired to produce hydrocarbons from a formation, or in which it is not desired to perform stimulation operations.

Figure 2:
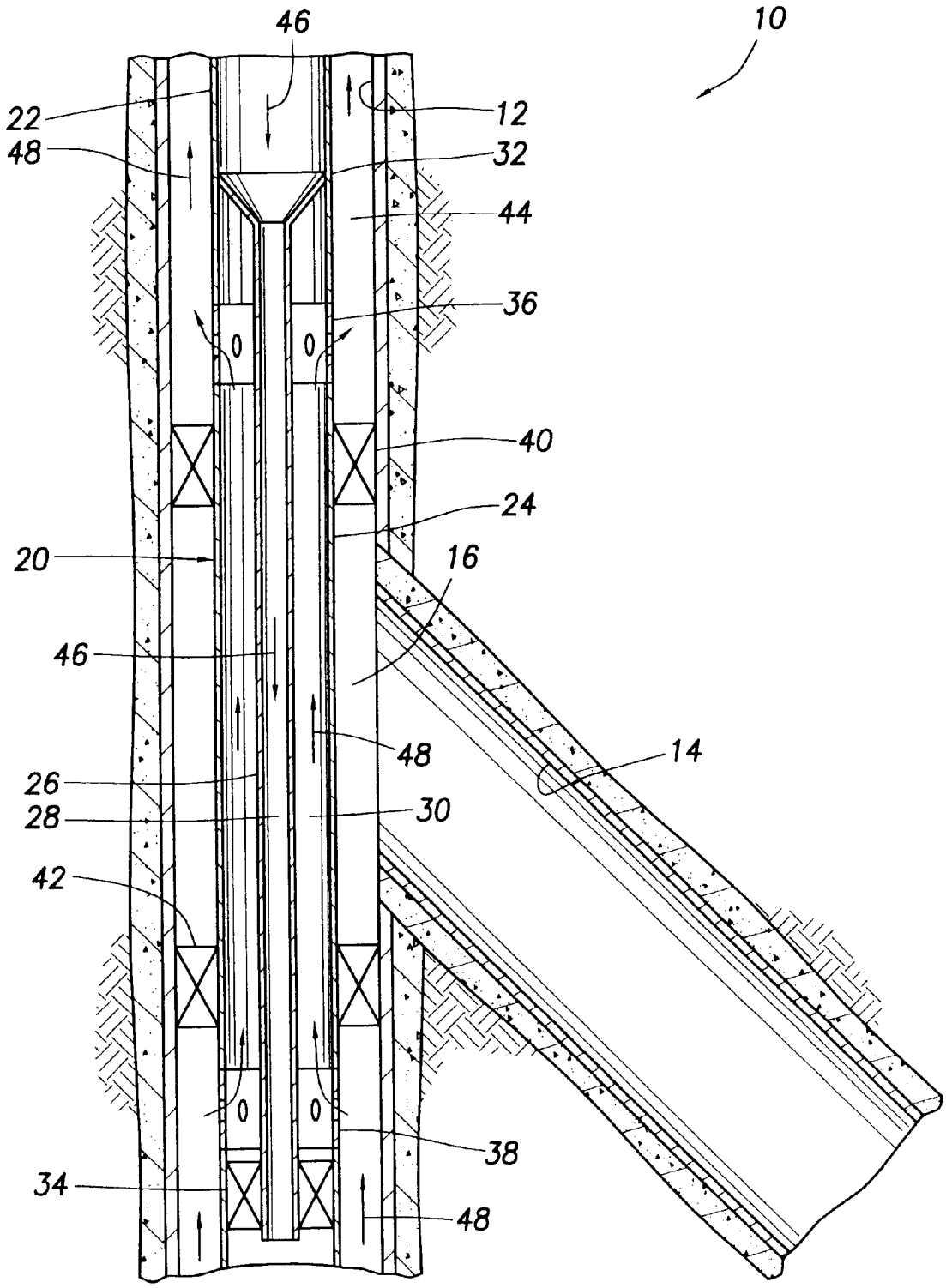
FIG. 2 is an enlarged scale schematic view of the method of FIG. 1, wherein an apparatus embodying principles of the present invention is being utilized in the method.

Referring additionally now to FIG. 2, a somewhat enlarged view of the wellbores 12, 14 and the junction 16 therebetween is representatively illustrated. Further steps of the method 10 have been performed in which a wellbore isolation assembly 20 is installed in the main wellbore 12 in a single trip. The assembly 20 is installed by conveying it into the wellbore 12 suspended from a work string 22.

The assembly 20 includes an outer tubular structure 24 and an inner tubular structure 26. For example, the outer structure 24 may include one or more lengths of liner and the inner structure 26 may include one or more lengths of tubing. A flow passage 28 is formed through the inner structure 26 and another flow passage 30 extends in the space between the inner and outer structures 24, 26.

The inner structure 26 is connected and sealed to the outer structure 24 at to a three-way tubular connector 32. The connector 32 is also the point at which the work string 22 is attached to the assembly 20. The inner structure 26 is also sealed to the outer structure at a seal 34. Preferably, the seal 34 is an o-ring seal or packing received in a polished bore formed in the outer structure 24, but other types of seals may be used without departing from the principles of the invention.

The outer structure 24 further includes two ported subs 36, 38 and two sealing devices 40, 42. An upper one of the ported subs 36 is positioned between an upper one of the sealing devices 40 and the connector 32. A lower one of the ported subs 38 is positioned between a lower one of the sealing devices 42 and the seal 34. When the sealing devices 40, 42 are sealingly engaged in the main wellbore 12 as depicted in FIG. 2, the upper ported sub 36 provides fluid communication between the flow passage 30 and an annulus 44 formed between the assembly 20 and the wellbore 12 above the upper sealing device 40 via one or more ports in a sidewall of the upper ported sub, and the lower ported sub 38 provides fluid communication between the flow passage 30 and the annulus 44 below the lower sealing device 42 via one or more ports in a sidewall of the lower ported sub.

Preferably, the sealing devices 40, 42 are of the type well known to those skilled in the art as cup packers. However, other types of sealing devices may be utilized in keeping with the principles of the invention. In the method 10, the packers 40, 42 are positioned so that they straddle the wellbore junction 16 and thereby seal between the assembly 20 and the wellbore 12 above and below its intersection with the wellbore 14. In this manner, the annulus 44 is divided into three portions, a middle one of which is in fluid communication with the wellbore junction 16 external to the assembly 20. The upper and lower annulus 44 portions are in fluid communication with the flow passage 30 via the ported subs 36, 38.

To perform a fracturing operation, a slurry (indicated by arrows 46) including fluid and proppant is pumped down the work string 22, through the flow passage 28 and into the formation or zone 18. Return circulation of fluid (indicated by arrows 48) is directed from the annulus 44 below the lower packer 42 to the flow passage 30 through the lower ported sub 38, and then from the flow passage 30 to the annulus 44 above the upper packer 40 through the upper ported sub 36.

Note that the method 10 permits two flow passages 28, 30 to be positioned across the wellbore junction 16, the flow passages being isolated from each other and from the junction in the assembly 20, and permits the annulus 44 above and below the assembly to be isolated from the junction 16. This result is accomplished in only one trip into the well.

Of course, a person skilled in the art would, upon a careful consideration of the above description of a representative embodiment of the invention, readily appreciate that many modifications, additions, substitutions, deletions, and other changes may be made to this specific embodiment, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of isolating a wellbore junction, the method comprising the steps of:

positioning an assembly in a first wellbore opposite an intersection between the first wellbore and a second wellbore, the assembly including an outer generally tubular structure and an inner generally tubular structure, a first flow passage being formed through the inner structure and a second flow passage being formed between the inner and outer structures, the first and second flow passages being isolated from the second wellbore;

engaging sealing devices between the assembly and the first wellbore straddling the intersection; and flowing fluid, via the first flow passage, through the assembly between the sealing devices while returning circulation of the fluid, via the second flow passage, through the assembly between the sealing devices.

2. The method according to claim 1, wherein a first one of the sealing devices isolates the intersection from a first annulus portion formed between the assembly and the first wellbore above the intersection, and wherein the flowing step further comprises flowing the fluid between the second flow passage and the first annulus portion.

3. The method according to claim 2, wherein a second one of the sealing devices isolates the intersection from a second annulus portion formed between the assembly and the first wellbore below the intersection, and wherein the flowing step further comprises flowing the fluid between the second flow passage and the second annulus portion.

4. The method according to claim 1, wherein in the positioning step, the inner structure is sealingly engaged with the outer structure at opposite ends of the inner structure.

5. The method according to claim 1, wherein the positioning and engaging steps are performed in a single trip into the first wellbore.

6. A method of treating a formation intersected by a first wellbore below an intersection between the first wellbore and a second wellbore, the method comprising the steps of:

positioning an assembly in the first wellbore, the assembly including first and second sealing devices, one of the first and second sealing devices being positioned at each opposite end of an elongated section of the assembly, the assembly further including an outer generally tubular structure and an inner generally tubular structure, a first flow passage being formed through the inner structure and a second flow passage being formed between the inner and outer structures;

sealingly engaging the first and second sealing devices in the first wellbore straddling the intersection between the first and second wellbores; and flowing a well treatment fluid through the first flow passage and into the formation.

7. The method according to claim 6, wherein in the flowing step, the first flow passage is isolated from the second wellbore.

8. The method according to claim 6, wherein in the sealingly engaging step, the first and second sealing devices divide an annulus formed between the assembly and the first wellbore into first, second and third portions, the second portion being in fluid communication with the second wellbore.

9. The method according to claim 8, wherein in the flowing step, the second flow passage is isolated from the second annulus portion and the second flow passage is in fluid communication with the first and third annulus portions.

10. The method according to claim 8, wherein the flowing step further comprises flowing the treatment fluid from the third annulus portion to the first annulus portion through the second flow passage.

11. A wellbore isolation system, comprising:

an assembly including an elongated section having first and second sealing devices at opposite ends of the section, the first and second sealing devices sealingly engaging a first wellbore straddling an as intersection between the first wellbore and a second wellbore, the assembly further including an outer generally tubular structure and an inner generally tubular structure, a first flow passage being formed through the inner structure and a second flow passage being formed between the inner and outer structures; and fluid flowing through the section via the first flow passage, the first flow passage being isolated from the second wellbore.

12. The system according to claim 11, wherein the second flow passage is isolated from the first flow passage and from the second wellbore.

13. The system according to claim 12, wherein the second flow passage is in communication with the first wellbore above and below the section.

14. The system according to claim 11, wherein the second flow passage extends through a first port in a sidewall of the second structure above the first sealing device, and the second flow passage extends through a second port in the second structure sidewall below the second sealing device.

15. The system according to claim 11, wherein the first and second sealing devices seal between the second structure and the first wellbore.

16. The system according to claim 11, wherein the assembly is installed in the first wellbore in a single trip into the first wellbore.

* * * * *